US010723972B2

(12) United States Patent
Vinther et al.

(10) Patent No.: US 10,723,972 B2
(45) Date of Patent: Jul. 28, 2020

(54) METHOD AND PLANT FOR SEPARATION OF WAX AND FIBERS FROM PLANTS

(71) Applicant: JENA TRADING APS, Høng (DK)

(72) Inventors: Per Vinther, Høng (DK); John Mark Lawther, Roskilde (DK)

(73) Assignee: JENA TRADING APS, Høng (DK)

( * ) Notice: Subject to any disclaimer, the term of this patent is extended or adjusted under 35 U.S.C. 154(b) by 519 days.

(21) Appl. No.: 15/315,898

(22) PCT Filed: Jun. 4, 2015

(86) PCT No.: PCT/EP2015/062501
§ 371 (c)(1),
(2) Date: Dec. 2, 2016

(87) PCT Pub. No.: WO2015/185688
PCT Pub. Date: Dec. 10, 2015

(65) Prior Publication Data

US 2017/0107451 A1 Apr. 20, 2017

(30) Foreign Application Priority Data

Jun. 4, 2014 (DK) ..... 2014 70325

(51) Int. Cl.
*C11B 11/00* (2006.01)
*C11B 1/14* (2006.01)
(Continued)

(52) U.S. Cl.
CPC ..... *C11B 11/00* (2013.01); *B02C 23/08* (2013.01); *C11B 1/04* (2013.01); *C11B 1/08* (2013.01); *C11B 1/14* (2013.01)

(58) Field of Classification Search
CPC ... C11B 11/00; C11B 1/04; C11B 1/08; C11B 1/14; B02C 23/08
See application file for complete search history.

(56) References Cited

U.S. PATENT DOCUMENTS 1,715,194 A 5/1929 Garcia
2,275,630 A 3/1942 Johnson et al.
(Continued)

FOREIGN PATENT DOCUMENTS

BR 9006044 6/1991
CN 101225448 7/2008
(Continued)

OTHER PUBLICATIONS

International Search Report and Written Opinion for Application No. PCT/EP2015/062501 dated Aug. 19, 2015 (8 pages).
(Continued)

*Primary Examiner* — Omar Flores Sanchez
(74) *Attorney, Agent, or Firm* — Casimir Jones, S.C.; Lisa V. Mueller

(57) ABSTRACT

A method and an plant for separating wax from a dried wax coated plant material, comprising mechanically processing the plant material in a dry process by using an apparatus adapted for deforming at least the outer surface of the plant material, so that the wax coating is cracked and released from the remaining, partly de-waxed, plant material; separating the plant material in a separator into a portion A comprising plant material with a relatively high content of cracked and released wax coating and a relatively low content of the remaining, partly de-waxed, plant material, and a portion B comprising respectively a relatively low content cracked and released wax coating and a relatively high content of the remaining, partly de-waxed, plant material; liquefying the wax contained in portion A, and separating the liquefied wax from the remaining, partly de-waxed, plant material in portion A.

8 Claims, 2 Drawing Sheets

(51) Int. Cl.

| | |
|---|---|
| ***C11B 1/08*** | (2006.01) |
| ***C11B 1/04*** | (2006.01) |
| ***B02C 23/08*** | (2006.01) |

(56) References Cited

U.S. PATENT DOCUMENTS

| | | | | |
|---|---|---|---|---|
| 2,275,661 | A | 3/1942 | Steinle et al. | |
| 2,662,893 | A | 12/1953 | Kurth | |
| 2,804,271 | A | 8/1957 | Pressing et al. | |
| 5,882,114 | A * | 3/1999 | Fukuyo | B01D 11/0226 366/300 |
| 7,192,524 | B2 * | 3/2007 | Almagro | B01D 11/0284 210/634 |
| 9,328,312 | B2 * | 5/2016 | Kumar | C11B 1/04 |
| 2004/0076732 | A1 * | 4/2004 | Valix | A23C 19/163 426/601 |
| 2009/0126719 | A1 * | 5/2009 | Almagro | B01D 11/0284 127/55 |
| 2013/0095318 | A1 * | 4/2013 | Lagaron Cabello | B82Y 30/00 428/402 |
| 2015/0368584 | A1 * | 12/2015 | Anderson | A61K 36/185 554/10 |
| 2017/0202895 | A1 * | 7/2017 | Hugh | A61K 36/185 |
| 2017/0202896 | A1 * | 7/2017 | Hugh | A61K 36/185 |

FOREIGN PATENT DOCUMENTS

| | | |
|---|---|---|
| CN | 102329693 | 1/2012 |
| CN | 102431073 | 5/2012 |
| CN | 102864015 | 1/2013 |
| CN | 203333621 U | 12/2013 |
| DE | 4431394 | 2/1996 |
| EP | 0339509 | 4/1989 |
| GB | 1056468 | 1/1967 |
| WO | 9516013 | 6/1995 |
| WO | WO 1995/016013 A1 | 6/1995 |
| WO | 03/092628 | 11/2003 |
| WO | 2006/047445 | 5/2006 |

OTHER PUBLICATIONS

Search Report from Danish Patent and Trademark Office for Application No. 2014 70325 dated Nov. 24, 2014 (3 pages).

TBH Web Team: "From Desert Plants to Dollars: Candelilla Wax Makind, and Wax Products", The University of Texas at Austin, Apr. 20, 2004 Retrieved from the Internet: URL:http://www.texasbeyondhistory.net/waxcamps/techniques.html [retrieved on Sep. 9, 2015] (16 pages).

Indian Office Action dated Aug. 19, 2019 issued in Indian Application No. 201617041184, 6 pages.

Chinese Office Action dated Aug. 2, 2019 and English Translation, issued in Chinese Application No. 201580040918.1, 21 pages.

* cited by examiner

METHOD AND PLANT FOR SEPARATION OF WAX AND FIBERS FROM PLANTS

CROSS-REFERENCE TO RELATED APPLICATIONS

This is a U.S. national stage entry of International Patent Application No. PCT/EP2015/062501, filed on Jun. 4, 2015, which claims priority to Danish Patent Application No. PA201470325, filed on Jun. 4, 2014, the entire contents of all of which are fully incorporated herein by reference.

FIELD OF THE INVENTION

The present invention relates to a method and a processing plant for separating plant wax and plant fiber from plants.

BACKGROUND OF THE INVENTION

The separation of wax and fibers from plants is used for many purposes, but mostly the wax that covers plants is separated from the remaining parts of the plant in order to use the remaining parts of the plant for different purposes, such as bedding material for animals, power generation, gasification, fermentation, ethanol extraction, production of structural components e.g. crop straw plates. In most of the situations the wax is separated from the remaining parts of the plant in order to improve the quality or efficiency of such productions.

U.S. Pat. No. 1,715,194 discloses an apparatus for separating the wax from Candelilla plants, where the plant material is first reduced in length in a crusher, whereafter it is introduced into a decorticating machine performing a combined sieving and beating process on the plant material. This Candelilla dewaxing machine is simple in structure but provides a relatively inefficient separation of wax.

In this relation CN patent application no. CN102431073A discloses a crop straw de-waxing machine, which comprises a case, a stirring device, a power device, a de-waxing agent supply device, a feed inlet and a discharge outlet. A rotating shaft which penetrates through the integral case is mounted on the case, a transmission wheel is mounted at one end of the rotating shaft and connected with the power device by a transmission component, the stirring device is mounted on the rotating shaft and consists of a rotary drum, a plurality of stirring paddles are uniformly distributed on the surface of the rotary drum, a de-waxing agent container is disposed above the case, and a liquid delivery pipe is arranged between the de-waxing agent container and the inside of the case. The de-waxing agent is added into the case via a de-waxing agent container and the power device drives the stirring device to sufficiently stir and de-wax straw fibers in the case. This crop straw dewaxing machine is simple in structure and provides a relatively high degree of separation of wax, but it requires a significant amount of de-waxing agent for the de-waxing process.

Commercially available plant waxes are not very common due to a shortage of economically attractive production methods and plant wax sources. Plant waxes have traditionally been extracted by use of organic solvents such as chloroform, benzene and hexane followed by solvent evaporation and purification. Recently, an extraction process using supercritical $CO_2$ has been disclosed.

The jojoba plant (*Simmondsia chinensis*), which grows in the semi-arid regions of Mexico and the U.S.A., is unique in producing wax esters rather than triacylglycerols in its seeds, and it has become a significant crop.

The leaves of the carnauba palm, Copernicia cerifera that grows in Brazil, have a thick coating of wax ("carnauba wax"), which can be harvested from the dried leaves.

Other vegetable "waxes" such as bayberry or Japan wax are better described as "tallows" as they consist mainly of high melting triacylglycerols.

Plant waxes are highly valued alternatives to waxes coming from the petrochemical industry, and may be used as natural and "green" substitutes for the mineral oil-based waxes in all sorts of use, including in cosmetics, medical additives, lubricants, polishes, surface coatings (wood, leather, garment, etc.), inks, paints, garment, etc., and even for use in candlelight.

Today, the major part of commercial plant waxes come from the jojoba plant and carnauba palm, but the production is far from being able to cover the potential market. Thus, there is a need for new ways of produce plant waxes in high quantum and at a relatively low price.

SUMMARY OF THE INVENTION

The present invention therefore provides a method and a processing plant for the extracting of wax from plants, and with the option of relatively inexpensive and simple production of large volumes of wax.

This is achieved by the following production steps:

a) mechanically processing the plant material in a dry process by using an apparatus adapted for deforming at least the outer surface of the plant material, so that the wax coating is cracked and released from the remaining, partly de-waxed, plant material,
b) conveying the plant material in a dust proof tube
c) separating the plant material in a separator into a portion A comprising plant material with a relatively high content of cracked and released wax coating and a relatively low content of the remaining, partly de-waxed, plant material, and a portion B comprising respectively a relatively low content cracked and released wax coating and a relatively high content of the remaining, partly de-waxed, plant material,
d) liquefying the wax contained in portion A,
e) separating the liquefied wax from the remaining, partly de-waxed, plant material in portion A.

According to the invention the use of a conveyor between the process of deforming the plant material and the separation process provides a high degree of separation from the wax from the remaining plant material in the separator than what is possible with a decorticator according to U.S. Pat. No. 1,715,194 where the beating of the plant material takes place simultaneously with the sieving process. Furthermore the amount of liquid necessary for the liquid process is significantly reduced in relation to what is necessary for the process according to e.g. CN patent application no. CN102431073A According to a preferred embodiment of the invention the portion A is liquefied by a process comprising adding an aqueous liquid to said portion A, and thereby providing the option of subsequently separating the wax from the aqueous liquid.

The plant material may preferably be deformed by cutting the plant material to comminuted plant material.

Furthermore the mechanical processing of the plant material may preferably comprise milling the plant material.

The separator may preferably comprise a sieve having sieve openings adapted for retaining said portion B on one side of the sieve, and allowing said portion A to pass the sieve.

In this relation the portion A is preferably forced through the sieve by suction.

According to a preferred embodiment of the invention the milling process is performed before said separating the plant material in said separator into said portion A.

The invention also relates to a processing plant adapted for separating wax from a dried wax coated plant material, and comprising a de-waxing container adapted for liquefying the wax content of a plant material arranged in said de-waxing container, and wherein the processing plant further comprises:

a) a crusher adapted crushing/deforming at least the outer surface of the plant material, so that the wax coating is cracked and released from the remaining, partly de-waxed, plant material,
b) a separator adapted for separating the plant material into a portion A comprising plant material with a relatively high content of cracked and released wax coating and a relatively low content of the remaining, partly de-waxed, plant material, and a portion B comprising respectively a relatively low content cracked and released wax coating and a relatively high content of the remaining, partly de-waxed, plant material,
c) a first conveyor adapted for conveying material from the crusher to the separator, and
d) a second conveyor adapted for conveying the portion A from the separator to said de-waxing container In a preferred embodiment the first and second conveyors each comprises a dust proof tube, comprising an inlet and an outlet opening arranged at each end of said dust proof tube.

The crusher may in a further preferred embodiment comprise:

a) a cutter adapted for cutting the plant material to comminuted plant material,
b) a mill adapted for milling the comminuted plant material, and
c) a third conveyor adapted for conveying the comminuted material from the cutter to the mill.

Furthermore the mill may advantageously comprise a hammer mill and/or a disc mill.

The separator may in a preferred embodiment comprise a sieve adapted for retaining said portion B on one side of the sieve, and allowing said portion A to pass the sieve.

In this relation the separator furthermore comprise a blower arranged for forcing said portion A through the sieve.

DETAILED DESCRIPTION OF THE INVENTION

Definitions

"Straw" means the remains of a agricultural plant, e.g. a cereal, after the seed head has been removed, i.e. the leaves and the stem/stover (nodes and internodes). Straw may also mean the whole of a high energy grass, such as for example elephant grass.

"Feedstock" means the plant material applied to mechanical treatment.

"Straw fibers" and "mill generated fiber" mean the fraction of mechanically treated feedstock enriched in fibers and low in wax content.

"Mill generated fines" means the fraction of mechanically treated feedstock enriched in wax content and low in fibers content.

"Straw fines" means the fiber fraction of mill-generated fines.

As mentioned above, wax is a surface component on leaves and the stem of most plants. The present invention may be applied to most kinds of plant feedstock comprising wax. In the following, however, a preferred embodiment of a processing plant and method is disclosed being adapted especially for the purpose of illustrating the invention used for processing wheat straw.

Wheat straw contains a substantial amount of wax, and is available in high amount as bio-waste from agriculture. Furthermore it is an example of a feedstock for production of biofuel where wax is a component which needs to be removed in a pre-treatment before fermentation. Other feedstock may be treated in the same way, or with minor modifications obvious to the skilled person.

Figure 1:
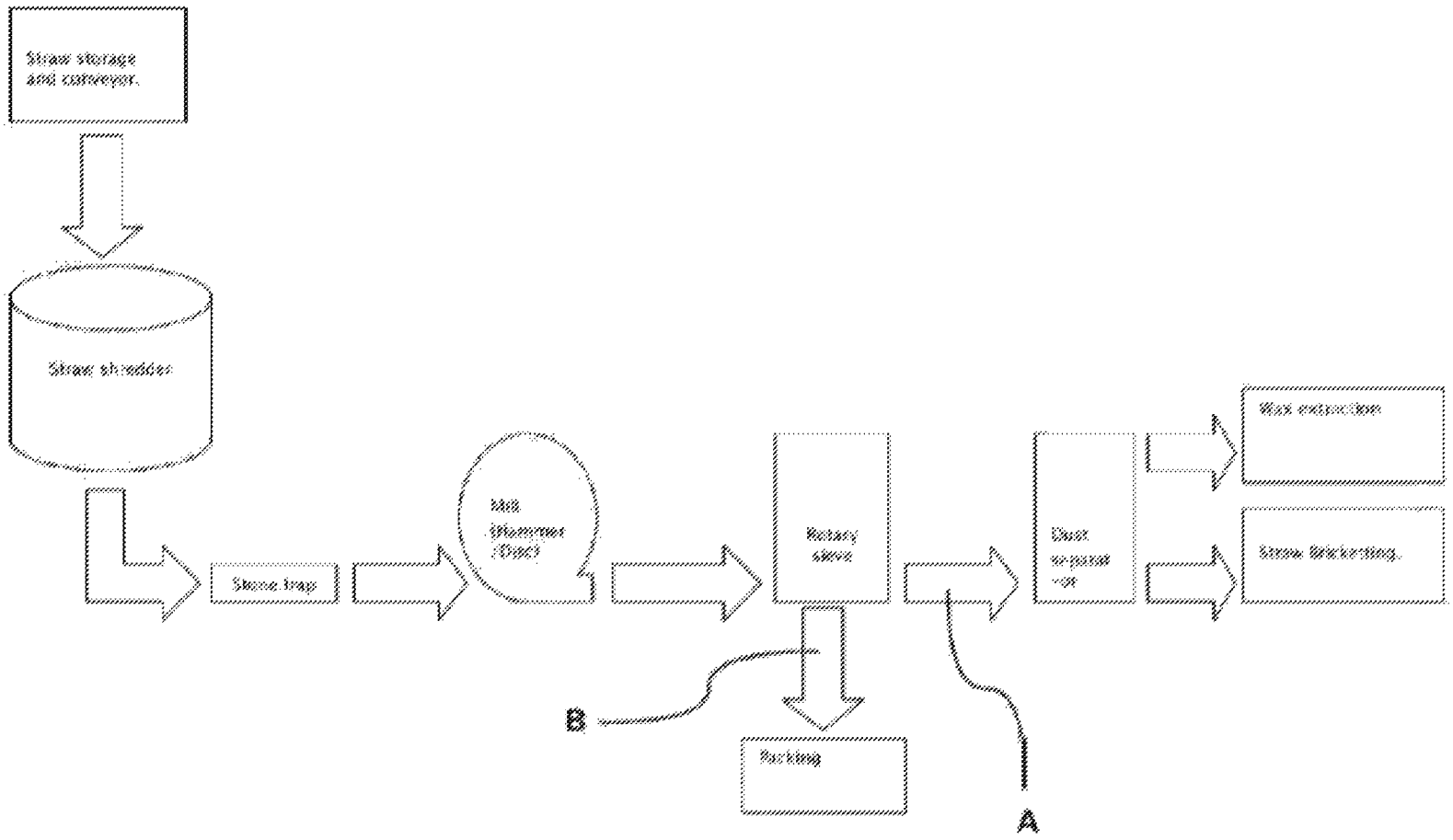
FIG. 1: Is a flow diagram showing a process as well as a setup for a processing plant according to the invention.
Figure 2:
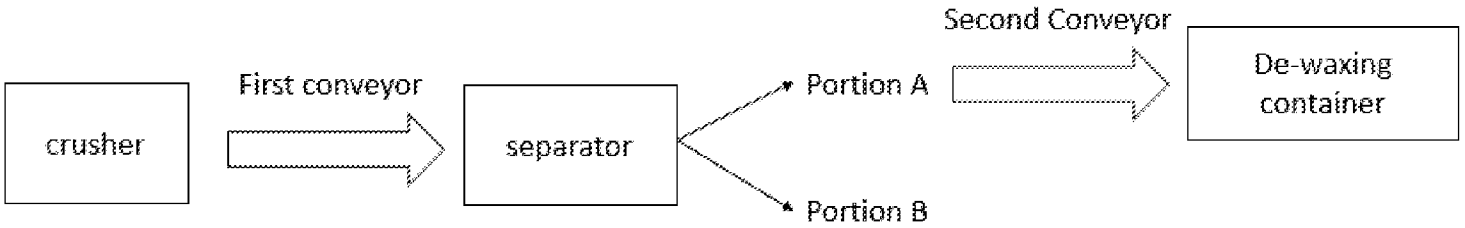
FIG. 2 is a flow diagram showing a processing plant adapted for separating wax from a dried wax coated plant material as described herein. The processing plant comprises a crusher adapted for crushing and/or deforming at least an outer surface of the plant material, so that the wax coating is cracked and released. The processing plant further comprises a separator adapted for separating the plant material into a portion (A) and portion (B). Portion (A) comprises plant material with a relatively high content of cracked and released wax coating and a relatively low content of the remaining, partly de-waxed, plant material. Portion (B) comprises a relatively low content cracked and released wax coating and a relatively high content of the remaining, partly de-waxed, plant material. The processing plant further comprises a first conveyor adapted for conveying material from the crusher to the separator, and a second conveyor adapted for conveying the portion A from the separator a de-waxing container. The dewaxing container may be adapted for liquefying the wax content of the plant material within the container.

According to FIG. 1 the mechanical treatment comprises at least a straw shredding and a straw milling process. First the dried straw material is supplied by conveying bales of dried straw to a straw shredder adapted for shredding the straw into shorter straw parts having an average length between 2 and 15 cm.

Thereafter the shredded straw is preferably passed through a stone trap for removing unwanted solids, such as stone, sand or soil, and to a straw mill for milling the short straw parts. Hereby the straw parts are deformed significantly and especially the surface of the straw material is deformed, so that a significant part of the wax on the straw surface is cracked and relieved from the straw part during the milling process.

In this relation the milling apparatus may comprise hammer mill and/or a disc mill or any other mill or combination thereof. In the preferred embodiment however, at least one disc mill is used.

In view of the present invention it will be apparent to the skilled person that the more the straw is deformed the more wax will be relieved from the straw material, and thereby it will be easy for the skilled person to suggest different mill constructions or combinations thereof by simple trial and error and for the purpose of efficiently milling the straw material in order to have as much wax as possible relieved from the straw material.

The milled straw material, comprising both a portion of straw fibers and a portion of mill generated fines is then conveyed to a separator adapted for substantially separating the straw fiber to a portion B (referenced "B" in the drawing) and the mill generated fines to a portion A (referenced "A" in the drawing), In this embodiment, being optimized for processing wheat straw the separator comprises a sieve arrangement, preferably a rotary sieve, being adapted for primarily separating the intermodal parts of the milled straw material from the rest of the milled straw material.

Hereby a volume of relatively short intermodal straw parts are obtained, being relatively free from wax coating on the surface. Due to its reduced wax coating, and thereby its increased absorbency such intermodal straw parts are very suitable as box straw material for various livestock, or for second generation bioethanol production.

The rest of the milled straw material is then transferred to a second part of the separator comprising e.g. a suction based dust separator, a cyclone or the like, being adapted for separating dust material including wax dust and particles from e.g. the straw nodal parts and leaves.

In view of the present invention it will be apparent to the skilled person that other types of separators may be used for the same purpose of separating the straw material into a portion B having a relatively low wax content, and a portion A having a relatively high wax content.

The straw nodal parts and leaves are hereby suitable for different products, such as straw brickets, pellets or the like.

The wax dust and particles (portion A) are hereafter according to the invention used in a liquid extraction process, e.g. by dissolving the wax using e.g. Dichloromethane, Chloroform, Ethanol or heated water.

The invention claimed is:

1. A processing plant adapted for separating wax from a dried wax coated plant material, and comprising a de-waxing container adapted for liquefying the wax content of a plant material arranged in said de-waxing container, and wherein the processing plant further comprises:

a. a crusher adapted crushing/deforming at least an outer surface of the plant material, so that the wax coating is cracked and released from the remaining, partly de-waxed, plant material, b. a separator adapted for separating the plant material into a portion (A) comprising plant material with a relatively high content of cracked and released wax coating and a relatively low content of the remaining, partly de-waxed, plant material, and a portion (B) comprising respectively a relatively low content cracked and released wax coating and a relatively high content of the remaining, partly de-waxed, plant material, c. a first conveyor adapted for conveying material from the crusher to the separator, and d. a second conveyor adapted for conveying the portion (A) from the separator to said de-waxing container.

2. A processing plant according to claim 1, wherein said second conveyor is arranged in a dust proof tube, comprising an inlet and an outlet opening arranged at each end of said dust proof tube.

3. A processing plant according to claim 1, wherein the crusher comprises:

a. a cutter adapted for cutting the plant material to comminuted plant material, b. a mill adapted for milling the comminuted plant material, and c. third conveyor adapted for conveying the comminuted material from the cutter to the mill.

4. A processing plant according to claim 3, wherein the mill comprises a hammer mill or a disc mill.

5. A processing plant according to claim 1, wherein the separator comprises a sieve adapted for retaining said portion (B) on one side of the sieve, and allowing said portion (A) to pass the sieve.

6. A processing plant according to claim 5, wherein the separator comprises a blower or a suction apparatus arranged for forcing said portion (A) through the separator.

7. A processing plant according to claim 6, wherein the suction tube is adapted for conveying the plant and wax material by suction provided at least partly by the blower.

8. A processing plan according to claim 1, wherein said first conveyor is arranged in a dust proof tube, comprising an inlet and an outlet opening arranged at each end of said dust proof tube.

* * * * *